United States Patent [19]

Cho

[11] Patent Number: 4,729,560

[45] Date of Patent: Mar. 8, 1988

[54] PIVOTAL EXERCISE HANDLES HAVING SPRING RESISTANCE

[76] Inventor: Myung H. Cho, 205-153, Cheongryang 2-Dong, Dongdaemoon-Ku, Seoul, Rep. of Korea

[21] Appl. No.: 61,418

[22] Filed: Jun. 12, 1987

Related U.S. Application Data

[60] Division of Ser. No. 761,701, Aug. 2, 1985, which is a continuation-in-part of Ser. No. 466,983, Feb. 15, 1983, Pat. No. 4,572,503.

[51] Int. Cl.[4] ..... A63B 5/20; A63B 21/30

[52] U.S. Cl. ..... 272/75; 272/68

[58] Field of Search ..... 272/74, 75, 67, 68, 272/122, 123, 124, 141; 73/379, 380, 381; D21/198; 81/321, 322; 30/234, 235, 236

[56] References Cited

U.S. PATENT DOCUMENTS

| | | | |
|---|---|---|---|
| 740,443 | 10/1903 | Korth | 272/68 |
| 922,330 | 5/1909 | Powell | 81/321 |
| 3,216,259 | 11/1965 | Bendix, Jr. | 272/68 |
| 3,290,043 | 12/1966 | Sorensen | 272/68 |
| 3,687,458 | 8/1972 | Proctor, Jr. | 272/68 |
| 4,262,898 | 4/1981 | Lee | 272/68 |
| 4,572,503 | 2/1986 | Cho | 272/68 |

*Primary Examiner*—Richard J. Apley
*Assistant Examiner*—S. R. Crow
*Attorney, Agent, or Firm*—Birch, Stewart, Kolasch, & Birch

[57] ABSTRACT

A handle for a skipping rope having a hand-grip structure which is provided with a fixed or rotatable thumb-grip to be engaged by the user's thumb. The handle is formed of two handle membrs which are biased apart by a spring. The handle members can be closed or diverged by displacing the position of an axial ring. The skipping rope is attached to one of the handle members by a supporter device. Electronic counting systems are also provided to count either the number of times the hand-grip is compressed or the number of revolutions made by a skipping rope by using a single electronic counter.

5 Claims, 31 Drawing Figures

PIVOTAL EXERCISE HANDLES HAVING SPRING RESISTANCE

CROSS REFERENCE TO A RELATED APPLICATION

This application is a divisional of copending application Ser. No. 761,701, filed on Aug. 2, 1985 which is a continuation-in-part of my copending application Ser. No. 466,983, filed Feb. 15, 1983, and entitled "PIVOTAL SKIPPING ROPE HANDLES HAVING SPRING RESISTANCE", now U.S. Pat. No. 4,572,503.

BACKGROUND OF THE INVENTION

The present invention relates to a handle for a skipping rope set and a hand-grip structure provided with a thumb-grip structure, and an electronic counter, and further, relates to a handle for a skipping rope set with a structure for a hand-grip which can be used as a hand-grip as well as a handle of a skipping rope and can also develop all the muscles of the right and left thumb concurrently.

A conventional handle of a skipping rope has a shape of a simple bar which is suitable for a man to grip and plays only a single role of connecting the hand to a skipping rope.

Further, a conventional hand-grip is not sufficient to enable the user to exercise all the muscles of the thumb due to its structure by which he/she can grasp it through only 4 fingers excluding the thumb. In addition, it is insufficient to use this device in another exercise wherein it can be used as a hand-grip only.

In my prior app. Ser. No. 466,983, as the thumb-grip is fixed to only one side of the first handle member 1', it is impossible to grip one thumb-grip structure with the right and left thumb alternatively. In other words, the user must use two hand-grip structures for both hands. Consequently, the hand-grip structures, especially the spring members, must be constructed in both handles of a skipping rope so that the product costs and sales prices are inevitably high.

Mechanical counters used in conventional hand-grip or skipping rope handles are not convenient or useful because they produce clicking noises when counting the number of times a grip is compressed, and moreover, the mechanical parts of which wear out easily when used for a long time. A counter used in a hand-grip of conventional devices counts only the number of gripping times and a counter used in a skipping rope set also only counts the number of skipping times, respectively. In other words, there is no device that counts the gripping times and skipping times together by the use of a single counter.

In my prior app. Ser. No. 466,983 when the user uses the second embodiment of the invention as a skipping rope handle, he/she must retain the two handle members by a retaining ring to form a substantially circular skipping rope handle. In this case, the two handle members are always under the tendency of diverging away from each other by the elasticity of the spring which is compressed in the recesses, and at the same time, the retaining ring is also under the influence of the elasticity of the spring. Consequently, it may happen that the retaining ring is either loosened or severed when used for a long period of time.

SUMMARY OF THE INVENTION

The first object of the present invention is to provide a skipping and grasping exerciser concurrently by providing a structure for a hand-grip in the skipping rope handle which is connected to a link so that the skipping rope is attachable to or detachable from the handle.

The second object of the present invention is to provide a handle of a skipping rope with an improved handgrip structure by providing a hinge structure and a coil spring positioned in the longitudinally extending grooves which are formed in the facing surfaces of the handle members while removing a spring elastically supported on both first ends of handle members and outwardly projected therefrom.

The third object of the present invention is to provide a handle of a skipping rope with a hand-grip structure including a fixed thumb-grip projected at one side of the handle to be engaged by a thumb.

The fourth object of the present invention is to provide a skipping rope handle with a hand-grip structure including a rotatable thumb-grip to be engaged by either thumb without any distinction between the right or left hand.

The fifth object of the present invention is to provide an electronic counting device which can overcome the defects of conventional mechanical counters and/or can count both the number of gripping times and number of skipping times alternatively using a single electronic counter.

The sixth object of the present invention is to provide an improved hand-grip with an electronic counter and a rotatable thumb-grip.

The seventh object of the present invention is to provide a conventional bar-shaped skipping rope handle with an electronic counter and a fixed thumb-grip to be engaged by a thumb.

The eighth object of the present invention is to provide a conventional skipping rope handle with an electronic counter.

Referring now more specifically to the drawings, the present invention will be described in detail hereinafter.

DETAILED DESCRIPTION OF PREFERRED EMBODIMENTS

Figure 4:
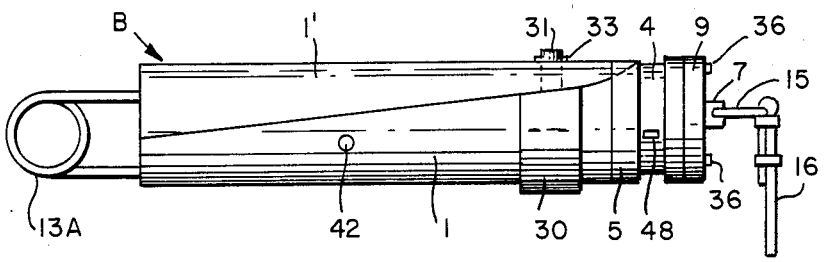
FIG. 4 is a side view of the handle of FIG. 3, with the handle members closed on one another.
Figure 7:
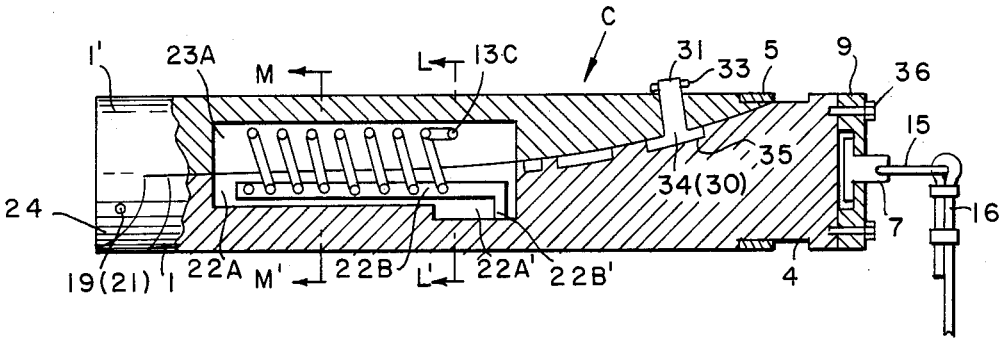
FIG. 7 is a side view of the handle of FIG. 6, with the handle members closed on one another, partly in section.

The drawings show handles intended mostly for the left hand, it being understood that handles for the right hand can be similarly made. The handle, when closed as shown in FIGS. 2, 4 and 7, has a shape and size similar to those of a conventional handle for a skipping rope.

Figure 1:
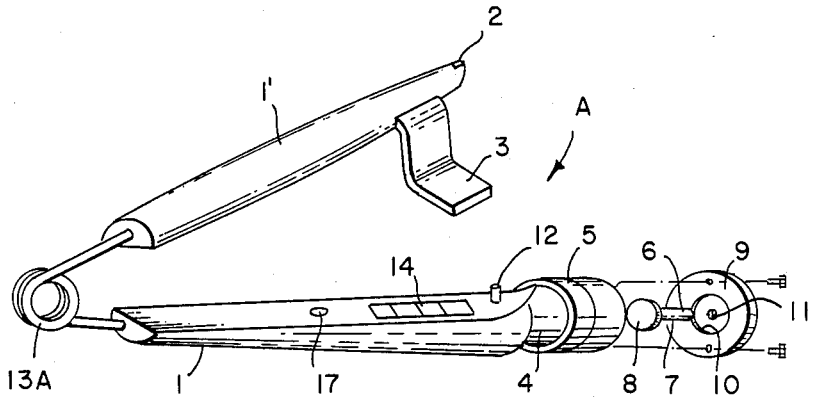
FIG. 1 is a perspective and exploded view of the first embodiment of the present invention in which a fixed thumb-grip is projected at one side of the first handle member 1'.
Figure 2:
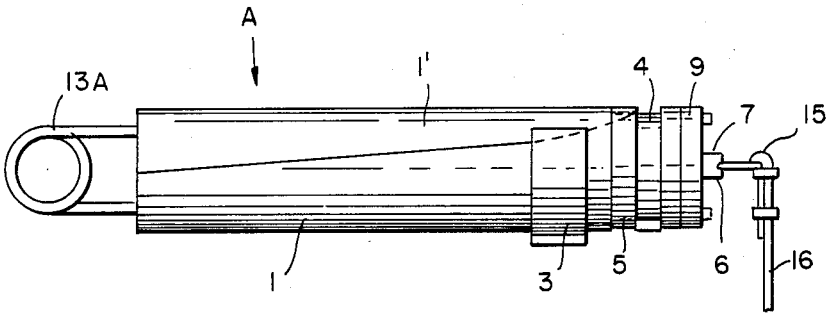
FIG. 2 is a side view of the handle in FIG. 1.

Referring first to FIGS. 1 and 2, the handle A is formed in two handle members (or the first handle member 1' and the second handle member 1) which are connected together at a first end of the two handle members by a coil spring 13A which act to bias the two handle members apart, as shown in FIG. 1. The two handle members 1 and 1' can be closed on one another as shown in FIG. 2, when so closed, the handle can be used for skipping. The handle may alternatively be used for exercising the user's grip by repeatedly forcing the two handle members 1 and 1' towards one another.

More specifically, the first handle member 1' is tapered to a point, from the first end attached to the spring 13A, and the second handle member 1 is shaped in a complementary manner, so that, when the two handle members are closed, they form together a cylindrical structure that is almost the same shape and size of a conventional skipping rope handle.

If desired, the two handle members can be held in the closed position shown in FIG. 2 by retaining means, in the form of a ring 5 which can slide axially into a concavity 4 in the second end of the second handle member 1. When in a righthand-most position as shown in FIG. 1, ring 5 is free of the first handle member 1', which is free to move away from the second handle member 1. If it is moved to the lefthand-most position as shown in FIG. 2, ring 5 overlies a cut-out portion 2 of the first handle member 1' and retains the latter in position. The first handle member 1' has a laterally extending "L" shaped thumb-grip 3. This thumb-grip 3 is fixed to one side of the handle member 1', adapted to be engaged by the user's thumb, thus enabling the thumb as well as the fingers to be exercised when used as a hand-grip and the handle to be gripped more tightly and stably when used as a handle of a skipping rope set.

For connecting the handle to a skipping rope 16, a supporting device is used. The supporting device included a supporter 8 with a protrusion and ring member. The supporter 8 united with a protrusion 7 having in its stem a fixing hole 6 is located in a recess 10 of a ringmember 9, with the protrusion 7 passing through a central aperture 11 in the ring-member 9. The ring-member 9 is then screwed to the end of the second handle member 1 through holes 37 by bolts 36, as shown in FIGS. 1, 3, 4, and 6. The skipping rope 16 can then be attached to the protrusion 7 by a link 15 secured in a connecting hole 6. Supporter 8 is retained by the ring-member 9, but can be readily rotated with respect to that member.

Figure 3:
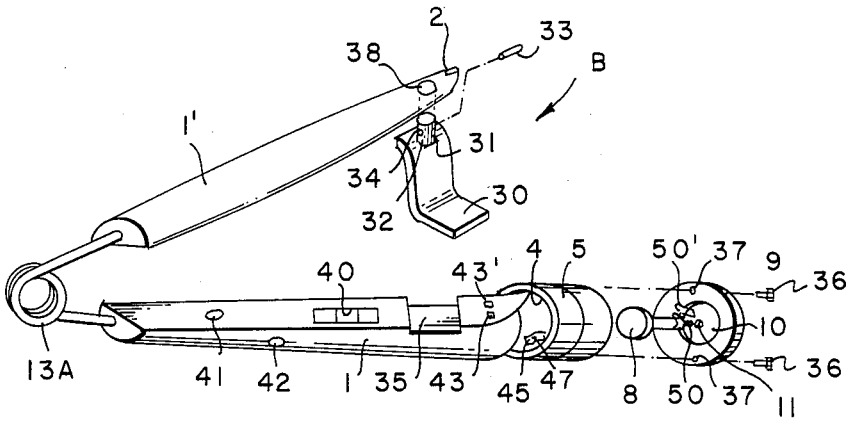
FIG. 3 is a perspective and exploded view of the second embodiment of the present invention in which a rotatable thumb-grip and an electronic counter are provided to the handle members.

FIGS. 3 and 4 show the second embodiment of the present invention in which a rotatable thumb-grip 30 is connected to the first handle member by means of a small cylindrical protrusion 31 which is projected upwardly on the flat portion 34 of the rotatable thumb-grip 30.

Figure 5:
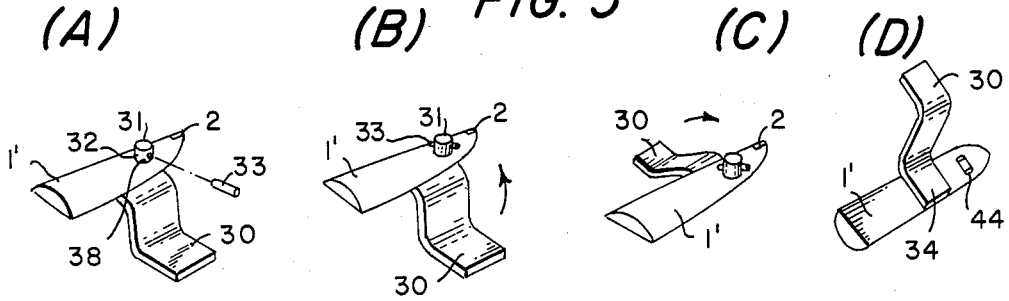
FIGS. 5A, 5B and 5C are fragmentary, perspective, and exploded views, respectively, of the first handle member with a rotatable thumb-grip.
FIG. 5D is a perspective view of the opposite side of FIG. 5B.
Figure 12:
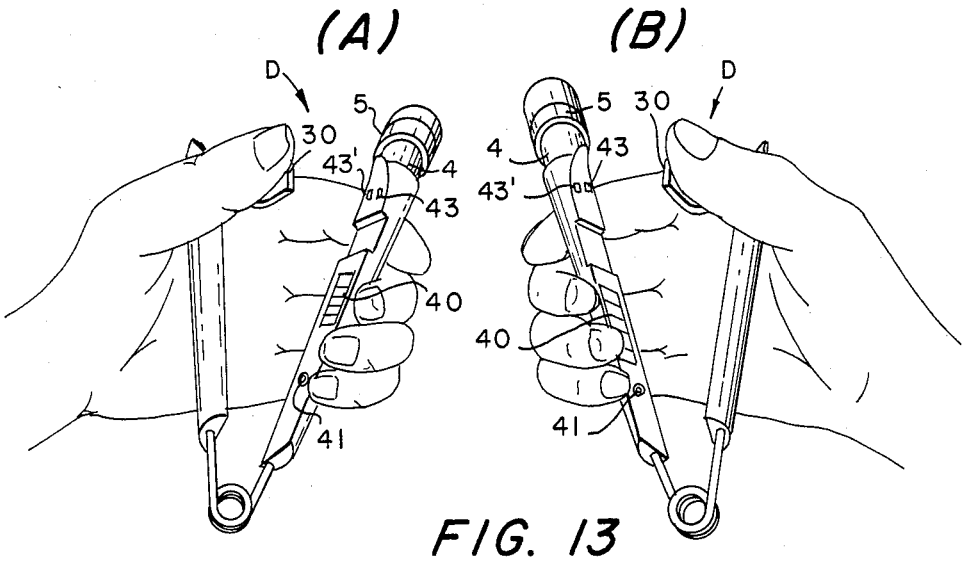
FIGS. 12A and 12B are perspective views of a hand-grip of FIG. 10 being engaged by the left and right hand respectively.

The protrusions 31 is fitted into the hole 38 which is positioned adjacent to the cut-out portion 2 as shown in FIG. 5A. A pin 33 passes through a hole 32 located in the stem of the protrusion 31 as shown in FIG. 5b. This pin 33 retains the protrusion 31 in position and prevents the rotatable thumb-grip 30 from slipping out of the hole 38 of the first handle member 1'. Then, the rotatable thumb-grip 30 can be rotated from the right side of the first handle member 1' as shown in FIG. 5B to the left side as shown in FIGS. 5C, and vice versa. Namely, when the rotatable thumb-grip 30 is positioned at the right side of the first handle member, the user engages his/her left thumb on the rotatable thumb-grip 30 as shown in FIG. 12a. When pushed to rotate to the left side, the rotatable thumb-grip 30 is positioned at the left side of the first handle member 1'. Thus, the user engages his right thumb on the rotatable thumb-grip 30 as shown in FIG. 12B. (FIGS. 12A and 12B are drawn to show the hand-grip only. These are quoted here only to show the positions of the thumb for convenience.) Accordingly, the user can develop all the muscles of both thumbs with this hand-grip structure B as shown in FIG. 3.

Since the flat portion 34 of the rotatable thumb-grip 30 is positioned beneath the first handle member, the flat portion 34 projects out to be as wide as the plane base side of the first handle member 1' as shown in FIG. 5D. Accordingly, a groove 35 is hollowed out in the inner surface of the second handle member 1 as shown in FIG. 3 for the flat portion 34 to be inserted into when the two handle members 1 and 1' are closed as shown in FIGS. 4 and 7.

A hand-grip structure with this rotatable thumb-grip is sufficient for the user to exercise his grip. Namely, as every skipping rope set has two handle members for each hand, one handle of a skipping rope can include two handle members, a spring means, and a rotatable thumb-grip, and the other handle of a skipping rope can have the shape of a simple bar with a fixed thumb-grip.

Consequently, as one handle of the skipping rope set does not need to have the structure of a hand-grip (especially the spring element), product costs and sales prices can be reduced greatly.

Figure 6:
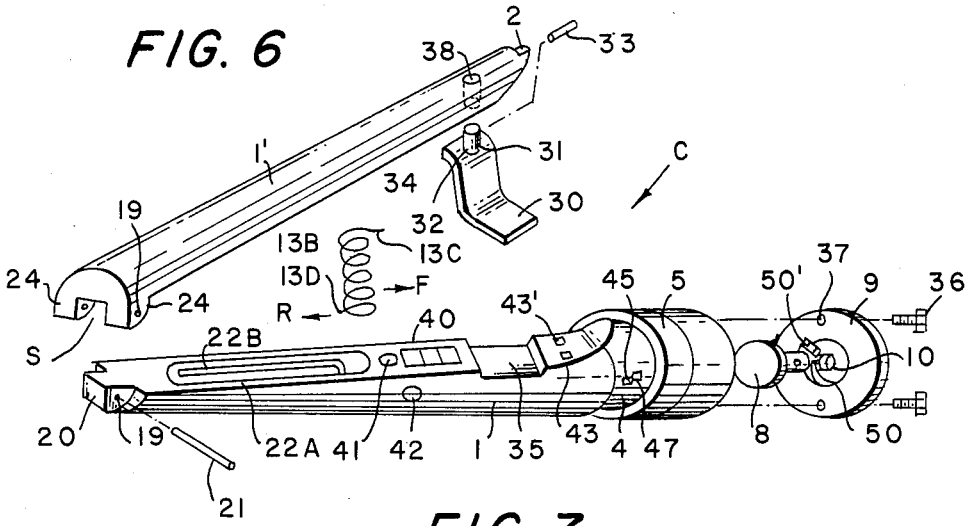
FIG. 6 is a perspective and exploded view of the third embodiment of the present invention.
Figure 8:
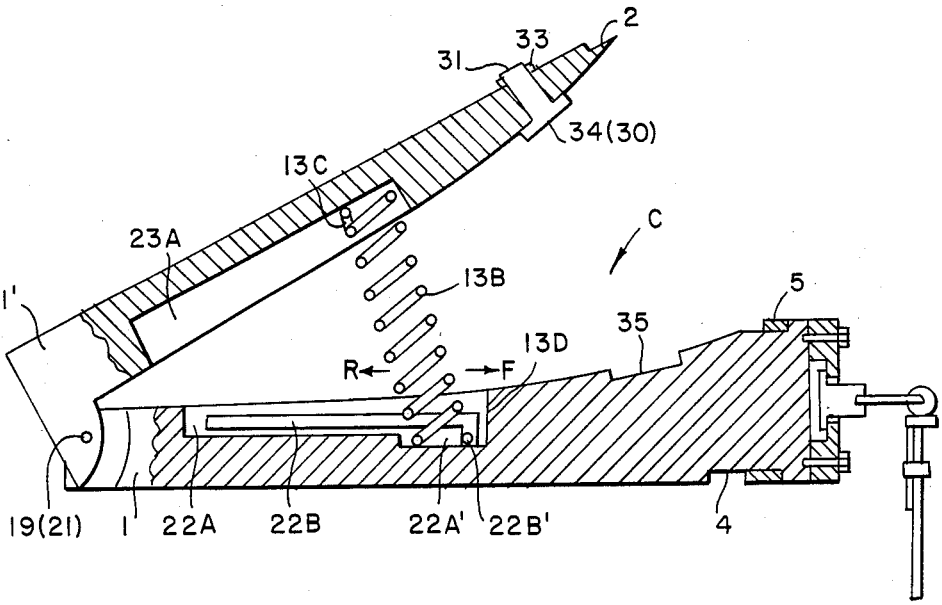
FIG. 8 is another view of the handle of FIG. 7, when two handle members are diverged away from one another, partly in section.

FIGS. 6, 7 and 8 show a third embodiment of the present invention. Most of the elements used in this embodiments are generally similar to that described earlier, and corresponding parts are given the same reference numerals. In this embodiment, however, the spring 13A in FIG. 3 is replaced by a hinge structure which connects the two handle members 1 and 1'. The first end of the second handle member 1 is formed with a tongue 20, a part thereof being arcuately cut away on either side of the tongue as shown in FIG. 6. The corresponding first end of the first handle member 1' has two outwardly shaped, downwardly directed, ribs 24 which define between them a slot S, which is complementary to the tongue 20, thus forming a tongue and groove joint. A pivot pin 21 attaches the two handle members together, the pin 21 passing through holes 19 in the tongue 20 and ribs 24. when the two handle members are so attached together, the ribs 24 are retained in the arcuate cut away parts of the second handle member 1.

Figure 9:
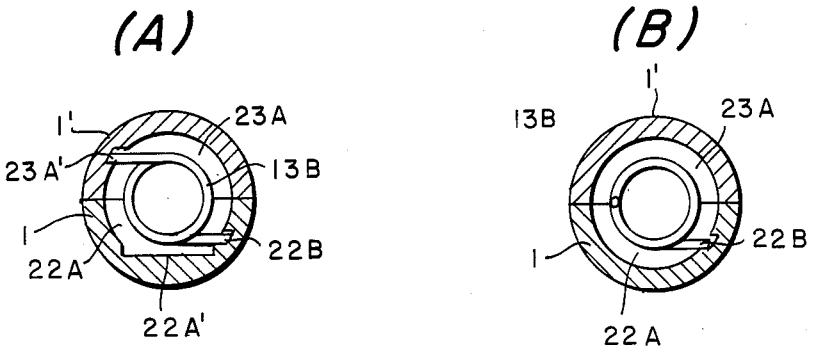
FIGS. 9A and 9B are sectional views of the Lines L—L' and M—M' in FIG. 7, respectively.

A helical compression spring 13B is located between the two handle members 1 and 1' as shown in FIGS. 6, 7 and 8. And further, in the facing surfaces of the two handle members 1 and 1', two longitudinally extending grooves 22A and 23A are carved out respectively to face each other for the spring 13B to be retained and laid down as shown in FIG. 7. A hole 23A' is made deep within one side of the groove 23A for the upper end 13C of the spring 13B to be rotatably secured. The position of this hole 23A' is shown in FIG. 9A which is a sectional view of the line L—L' in FIG. 7. And a right-angle shaped stria 22B is formed deep in one side of the groove 22A for the lower end 13D of the spring 13B to be inserted and slidably retained as shown in FIGS. 7 and 8. This stria 22B is also shown in FIGS. 9B in section. At the right-end of the groove 22A, a recess 22A' is formed to receive the whole lower part of the spring 13B when the spring 13B stands upwardly as shown in FIG. 8.

If it is desired to use the present invention as a handle of a skipping rope, the user draws the spring 13B a little upwardly. Then, the whole lower portion of the spring 13B together with the lower end 13D of the spring 13B being positioned deep in the right end 22B' of the stria 22B is also drawn upwardly to the right-angled point of the stria 22B. At this time, the user, drawing the two handle members to one another, pushes the lower part of the spring 13B to the direction of arrow R in FIG. 8. Then, the spring 13B slides laterally and is laid down in the grooves 22A and 23A. Accordingly, the two handle members 1 and 1' are closed to form one skipping rope handle C as shown in FIG. 7.

If the present invention is used as a hand-grip, the user makes the two handle members 1 and 1' diverge by moving the ring 5 to the righhand-most position. At this time, as the upper end 13C of the spring 13B is rotatably secured to the hole 23A' and the lower end 13D of the spring 13B is slidably retained in the stria 22B, the whole lower part of the spring 13B moves in the direction of the arrow F as shown in FIG. 8. After the lower end 13D together with the whole lower portion of the spring 13b moves to the right-angled point of the stria 22B, then, the lower end 13D moves downwardly to the deep end 22B' of the stria 22B. At this moment, the whole spring 13B is also positioned upwardly in the recess area 22A'. Consequently, as the upper end 13c of the spring 13B is retained in the hole 23A' and the whole lower portion of the spring 13B is retained in the recess 22A', the spring 13b can't be removed from the handle members 1 and 1', now slipped into the grooves 22A and 23A by itself unless it is intentionally drawn upwardly and pushed into the grooves 22A and 23A by the user.

Then, using this hand-grip structure C, the user can exercise and develop his/her grip. Even further, since the spring 13B can be laid down in the grooves 22A and 23A, the two handle members and retaining means are not affected by the elasticity of the spring 13B. Accordingly, the user can grip this handle C more firmly and stably when jumping rope and can also carry it as a simple bar with ease and convenience when using it only as a hand-grip by removing the skipping rope.

Figure 16:
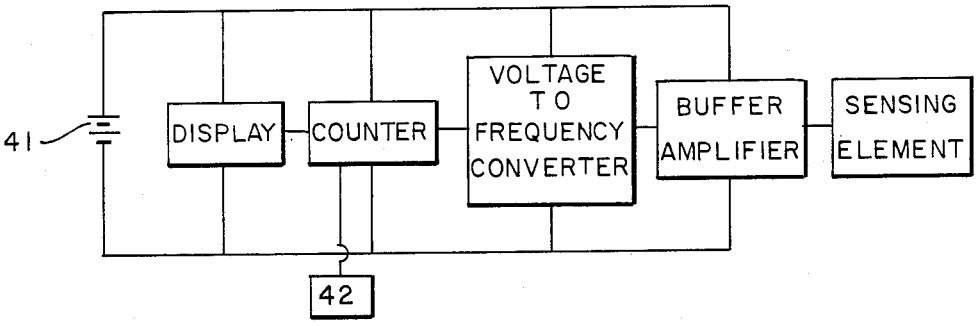
FIG. 16 is a block diagram of a circuit employed in the present invention.

Referring now to the counting system for use with the present invention, the shaft of the second handle member 1 is provided with a well-known electronic counter 40, reset button 42, and a power source 41, as shown in FIGS. 3 and 6. (As the FIGS. 1 and 2 are transferred from my prior app. Ser. No. 466,983, the electronic counting system is not drawn in FIGS. 1 and 2 for convenience.) Electrical leads extend from the power source 41, through the inside of the handle, to numerous electrical contacts. The counter 40 is comprised of various well-known elements such as a buffer-amplifier, a voltage-to-frequency converter, an electronic digital counter, and a digital display. FIG. 16 shows a block diagram of the circuit according to the present invention using these elements.

On the flat back side of the first handle member 1', a flat contact-strip 44 is located somewhere in between the hole 38 and the cut out portion 2 as shown in FIG. 5D. On the inner tilting surface of the second handle member 1, contact-points 43 and 43' are installed somewhere in between groove 35 and concavity 4 to be exactly contacted with the flat contact-strip 44 which is projected up slightly higher than the surface level of the flat back side of the first handle member 1'. The contact-points 43 and 43' are drawn in FIGS. 3 and 6.

Figure 14:
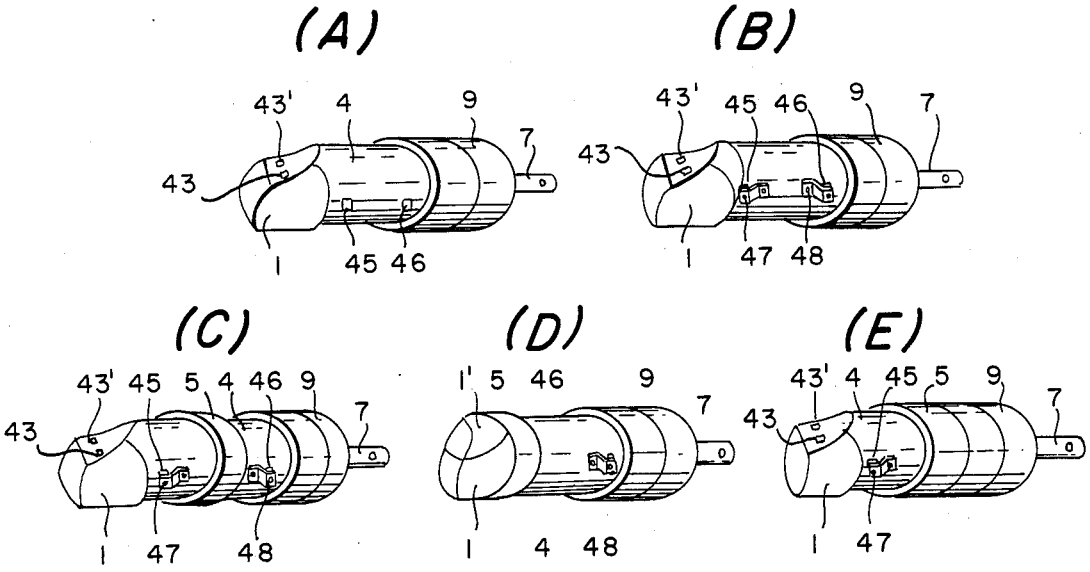
FIGS. 14A, 14B, 14C, 14D, and 14E are fragmentary end views of the second handle member 1 showing the positions of switching points and retaining means.

On the concavity 4 made for the ring 5 to slide axially, contact-points 45, 46 and switching-strips 47, 48 are installed as shown in FIGS. 14A to 14B. FIG. 14A shows the concavity 4 with the contact-points 45 and 46. In this drawing, the ring 5 is not drawn for convenience. In FIG. 14B, the switching-strips 47 and 48 are installed near the contact-points 45 and 45, respectively. It will be well understood from this figure that, without any external pressures, the switching-strips 47 and 48 are so attached as to not be normally contacted with the contact-points 45 and 46, respectively. In this drawing, the ring 5 is also not drawn for convenience. FIG. 14C shows the concavity 4 with ring 5, all the contact-points and switching-strips being attached. In this drawing, the ring 5 is positioned in the middle of the concavity 4, so that the switching-strip is not contacted with the contact point. In FIG. 14D, the ring 5 is moved to the lefthand-most position to overlay the cut out portion 2 of the first handle member 1' forming a skipping rope handle B in FIG. 4 (or handle C in FIG. 7). In this embodiment, the switching-strip 47 is pressed by ring 5, and at the same time, contacts the contact-point 45. In FIG. 14E, the ring 5 is moved to the righthand-most position to overlay and press the switching-strip 48. In this case, the switching-strip 48 contacts the contact-point 46.

Figure 15:
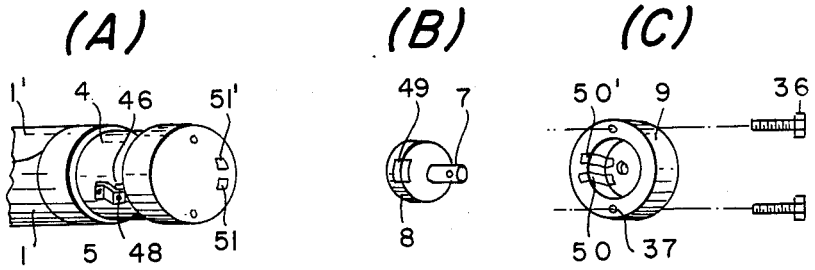
FIGS. 15A, 15B, and 15C are perspective and exploded views of the end part of the handle member and supporting means, which show the positions of contact-points and contact-strips.

As shown in FIGS. 15A, 15B, and 15C, on the inner surface of the ring member 9 are installed contact-strips 50 and 50' which contact the contact-points 51 and 51' when the ring-member 9 is screwed to the end of the second handle member 1 by bolts. The contact-strip 49 is installed on the supporter 8 slightly higher than the surface level of the supporting means in order to be contacted with these contact-strips 50, 50'.

Figure 17:
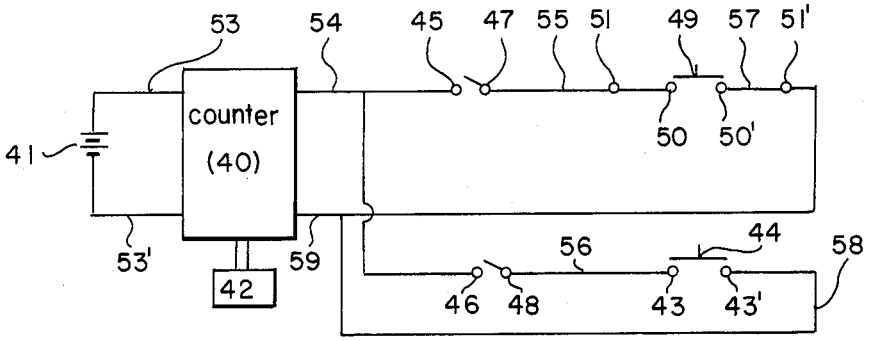
FIG. 17 is a circuit diagram of a counting system which counts the skipping and gripping times, alternatively.

The circuit will now be described in detail with reference to FIG. 17.

The electrical lead 54 from the counter 40 extends and is connected to the contact-points 45 and 46. The electrical lead 55 from the switching-strip 47 extends, via the contact-point 51, to the contact strip 50 and the electrical lead 57 from the contact-strip 50' is connected, via the contact-point 51', to the electrical lead 59 which extends to the counter 40. The electrical lead 56 from the switching strip 48 extends to the contact-point 43 and the electrical lead 58 from the contact-point 45' is connected to the electrical lead 59 which extends to the counter 40. Further, the electrical leads 53, 53' from the power source 41 are connected to the counter 40. Numerals 44 and 49 denote the contact-strips. Numeral 42 denotes the reset button.

All of these contact-points, contact-strips, and switching-strips are made of conductive materials and are attached to the handle members and other elements by means of bolts or adhesives, and are also connected to the electrical leads by soldering, welding, or any other known methods. In addition, all of the elements used in the counting system are so made and constructed as to be perfectly insulated.

The counting processes are as follows. At first, if it is desired to use the present invention as a skipping rope handle, the user moves the ring 5 to the lefthand-most position and retains the first handle member 1' in position as shown in FIG. 4. At this moment, the ring 5 also overlies and presses the switching-strip 47 to contact the contact-point 45. Thus, the current flows from the power source 41, through the leads 54 and 55, to the contact-strip 50 (see FIG. 17). Under these circumstances, the user rotates the supporter 8 connected to the skipping rope. Every time the supporter 8 rotates, the contact-strip 49 contacts the contact-strips 50, 50' and produces a pulse signal. Accordingly, this signal is transmitted, through the electrical leads, to the counter for displaying the number of times the skipping rope makes a full revolution.

In turn, it if is desired to use the present invention as a hand-grip, the user moves the ring 5 to the righthand-most position to diverge the two closed handle members 1 and 1' away from each other. At this time, the switching-strip 47 is separated from the contact-point 45. the ring 5 further overlies and presses the switching-strip 48 to contact the contact-strip 46. Then the current flows from the power source 41, through the electrical leads 54 and 56, to the contact-point 43. Under these conditions, every time the two handle members are closed, the contact-strip 44 contacts the contactpoints 43 and 43' to produce a pulse signal. Accordingly, this signal is transmitted through the electrical leads to the counter 40 for displaying the number of times the handles are gripped together.

As previously explained, by displacing the position of the ring 5, the user can count the number of skipping rope revolutions and the number of times the handles are gripped alternatively with a single counter.

Figure 10:
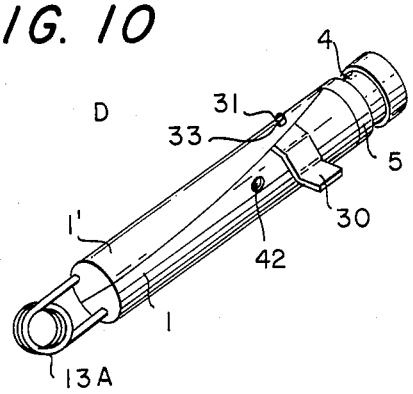
FIGS. 10 and 11 are perspective views of the fourth embodiment of the present invention, which are comprised of most of the elements in FIGS. 3 and 6 excluding the supporting means, respectively, only to be used as a hand-grip.
Figure 11:
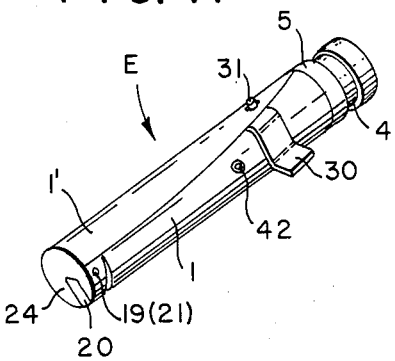

The fourth embodiment of the present invention is shown in FIGS. 10, 11., 12A, 12B and 18. As described in the prior embodiments of the present invention, the skipping rope is attached to the second handle member 1 by a supporting means. But, on occasion, some users may want to carry the present invention without a skipping rope and use it as a hand-grip with rotatable thumb-grip only.

Figure 18:
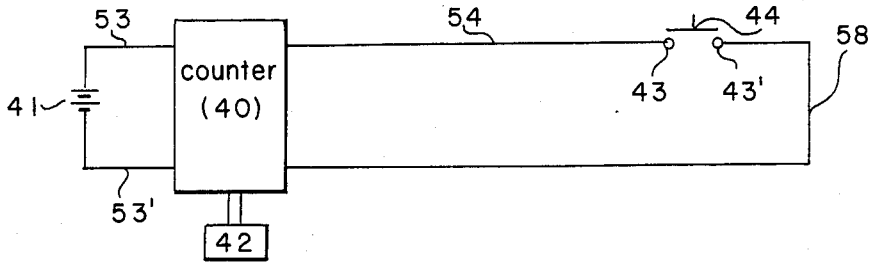
FIG. 18 is a circuit diagram of a counting system for a hand-grip.

This requirement will be easily met by removing the ring-member 9 with contact-strips 50 and 50', and supporter 8 with contact-strip 49 from the second handle member 1, and connecting the circuit as shown in FIG. 18. Namely, the electrical lead 54 from the counter 40 directly extends to the contact-point 43. The electrical lead 58 from the contact-point 43' extends to the counter 40. The electrical leads 53 and 53' from the power source 41 are connected to the counter 40. Therefore, in this embodiment, there are no contact-points or switchingstrips on the concavity 4. When the user closes the two handle members, the contact-strip 44 contacts the contact-points 43 and 43' and produces a pulse signal. This signal is transmitted to the counter and displays the counted number of times a gripping action occurs. When the user wants to carry this hand-grip as a simple bar by closing the two handle members with the ring 5, the contact-strip 44 also contacts the contact-points 43 and 43'. In this case, the current can be broken by the reset button 42.

The remaining elements are all the same as those in the prior embodiments. Namely, the rotatable thumb-grip 30 can be rotated from the right side of the first handle member 1' to the left side, and vice versa. Accordingly, with this hand-grip D of FIG. 10 (of hand-grip E of FIG. 11), the user can engage his/her left and right thumb as shown in FIGS. 12A and 12B and develop all the muscles of both hands. Further, as the normal shape of a conventional hand-grip is that of a diverged twig, it is very inconvenient and troublesome to carry along. But in the present invention, by moving the ring 5, the hand-grip D (or E) can be closed to form a simple bar as shown in FIGS. 10 and 11 so that it can be carried along with ease and convenience.

Figure 13:
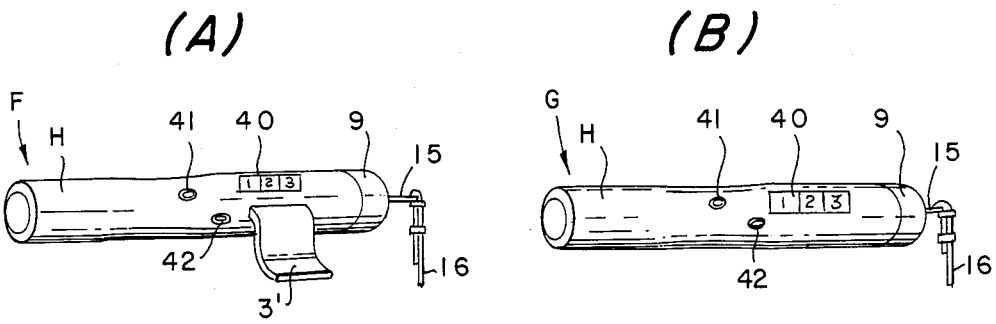
FIG. 13A is a perspective view of the fifth embodiment of the present invention, in which a conventional bar-shaped skipping rope handle is provided with an electronic counter and a fixed thumb-grip.
FIG. 13B is a perspective view of the sixth embodiment of the present invention, in which a conventional bar-shaped skipping rope handle is provided with an electronic counter.

An electronic counting system and a fixed thumb-grip in the prior embodiments can also be employed in a conventional bar-shaped skipping rope handle. Namely, the fifth embodiment of the present invention is provided with a fixed thumb-grip 3' and an electronic counter. FIG. 13A shows a handle F in which the fixed thumb-grip 3' projects to the right side of one handle to be engaged by the left hand. For the right hand, the fixed thumb-grip 3' projects to the left side of the other handle (not shown).

FIG. 13B shows the sixth embodiment of the present invention which is a simple bar-shaped conventional skipping rope handle without thumb-grip structure.

Figure 19:
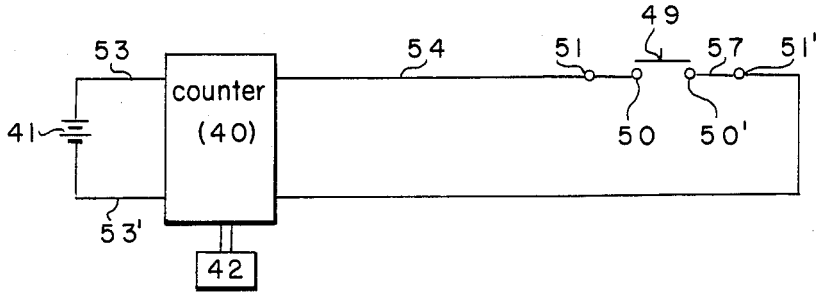
FIG. 19 is a circuit diagram of a counting system for a skipping rope handle.

The counting elements and counting systems employed in the handle F of FIG. 13A and the handle G of FIG. 13B are transferred from, and are the same as some of those in the prior embodiments of the present invention. Namely, inside of the handle are mounted a power source 41, a reset button 42, and an electronic counter 40. The contact-strip 49 on the supporter 8 and the contact-strips 50 and 50' on the inner surface of the ring member 9 are also the same as those in the prior embodiments such as shown in FIGS. 15A, 15B and 15C. The circuit diagram is shown in FIG. 19. The electrical lead 54 from the electronic counter 40 extends, through the inside of the handle, via the contact-point 51, to the contact-strip 50. The electrical lead 57 from the contact-strip 50' extends, via contact-point 51', to the counter 40. The electrical leads 53 and 53' from the power source 41 are connected to the electronic counter 40. Numeral 42 denotes the reset button. When the user rotates the skipping rope connected to the supporter 8, the contact-strip 49 contacts the contact-strips 50 and 50', and produces a pulse signal. This signal is transmitted to the counter 40 and displays the number of times the skipping rope makes a full revolution.

The handles described above enable one device to be used both as a handle for a skipping rope and as a hand-grip. The rotatable thumb-grip (or the fixed thumbgrip) connected to a handle member enables the user to develop all themuscles of his/her thumbs and to grip the handles more firmly and effectively. Further, the electronic counting system enables the user to count the skipping revolutions and number of repeated grips with a single electronic counter while improving many defects that the mechanical counters have.

I claim:

1. A skipping rope handle comprising:

a first handle member being substantially semicircular in cross-section and having a first end, a gripping portion, and a second end;

a second handle member being substantially semicircular in cross-section and having a first end, a gripping portion, and a second end;

a hinge structure, said hinge structure including a hinge pin for pivotally connecting said first end of said first handle member to said first end of said second handle member, a cylindrical helical spring having upper and lower ends positioned within longitudinally extending first and second recessed portions within facing surfaces of said first and second handle members, wherein said cylindrical helical spring is selectively laid down and hidden from view within said first and second recessed portions, said first recessed portion has located therein a cavity deep in the side thereof for rotatably securing said upper end of said cylindrical helical spring, said second recessed portion has located therein a stria for inserting and slidably retaining said lower end of said cylindrical helical spring, said second recessed portion further includes means for stably positioning a lower portion of said cylindrical helical spring when said spring stands upwardly said handle members biased apart by said helical spring when in the standing position for exercise purposes;

supporting means including a ring member being mounted relative to said second end of said second handle member and a supporter being rotatably secured in a recess of said ring member for attaching a jump rope to said second handle member; and retaining means in the shape of a ring axially displaceable along said first and second handle members for selectively retaining said handle members together, said retaining means being mounted in a concavity adjcent to said second end of said second handle member wherein, upon actuation, said biased handle members are selectively retained to form said skipping rope handle of a substantially circular cross-section.

2. A skipping rope handle according to claim 1, further including a rotatable thumb-grip, said rotatable thumb-grip fits into a slot formed adjcent said second end of said first handle member by means of a protrusion projecting from a flat portion of said rotatable thumb-grip, said protrusion of said rotatable thumb-grip being retained in said slot by means of a pin passing through an opening in said protrusion, said inner surface of said second handle member further includes means formed therein for receiving said flat portion of said rotatable thumb-grip upon closing said first and second handle members together.

3. A skipping rope handle according to claim 1, further including an electronic counting system, comprising:

a power source;

a reset button;

counter means for counting the number of rotations said supporting means makes while an individual is jumping rope and for counting the number of gripping times;

said counter means including a buffer amplifier, a voltage-to-frequency converter, an electronic digital counter, and a digital display;

means for providing pulse signals to said counter means via a plurality of electrical leads;

said means for providing pulse signals includes a contact strip on an inner flat surface of said first handle member and contact points on the inner surface of said second handle member wherein said strip and points contact upon closing of said first and second handle members, contact points and open switching strips on said concavity wherein said points and strips are in a superimposing relationship, contact points at the end of said second handle member and contact strips on the inner surface of said ring member wherein said points and strips are in electrical contact upon securing said ring member to said second handle member, and a contact strip on said supporter wherein said strip operatively engages with said strips of said ring member;

said plurality of electrical leads include a first lead extending from said counter to said contact points on said concavity through said second handle member, a second lead extending from said counter to at least one of said contact points on the inner surface of said second handle member and to at least one of said contact strips on the inner surface of said ring member, a third lead extending from one of said switching strips on said concavity to one of said contact points on the inner surface of said second handle member, a fourth lead extending from one of said switching strips on said concavity, through one of said contact points at the end of the second handle member, to one of said contact strips on the inner surface of said ring member, and fifth and sixth leads extending from said power source to said counter wherein upon actuation, a flow of current is converted to said contact points on the inner surface of said second handle member or to said contact strips on the inner surface of said ring member by displacing said retaining means along the length of said skipping rope handle.

4. A hand grip comprising:

a first handle member being substantially semicircular in cross-section and having a first end, a gripping portion, and a second end;

a hinge structure, said hinge structure including a hinge pin for pivotally connecting said first end of said first handle member, a cylindrical helical spring having upper and lower ends positioned within longitudinally extending first and second recessed portions within facing surfaces of said first and second handle members, wherein said cylindrical helical spring is selectively laid down and hidden from view within said first and second recessed portions, said first recessed portion has located therein a cavity deep in the side thereof for rotatably securing said upper end of said cylindrical helical spring, said second recessed portion has located therein a stria for inserting and slidably retaining said lower end of said cylindrical helical spring, and said second recessed portion further includes means for stably positioning a lower portion of said cylindrical helical spring when said spring stands upwardly said handle members biased apart by said helical spring when in the standing position for exercise purposes;

retaining means in the shape of a ring axially displaceable along said first and second handle members for selectively retaining said handle members together, said retaining means being mounted in a concavity adjacent to said second end of said second handle member wherein, upon actuation, said biased handle members are selectively retained to form said handle grip of a substantially circular cross-section;

a rotatable thumb-grip;

said rotatable thumb-grip fits into a slot formed adjcent said second end of said first handle member by means of a protrusion projecting from a flat portion of said rotatable thumb-grip wherein said protrusion of said rotatable thumb-grip is retained in said slot by means of a pin passing through an opening insaid protrusion;

said inner surface of said second handle member further includes means formed therein for receiving said flat portion of said rotatable thumb-grip upon closing said first and second handle members together.

5. A hand-grip according to claim 4, further including:

a power source;

a reset button; and counter means for counting the number of times an individual squeezes said first and second handle members into a contacting relationshp;

said power source, reset button, and counter means being mounted on or within the body of said second handle member;

said inside surface of said second handle member further includes two contact points;

the inner flat surface of said first handle member includes a contact strip for producing pulse signals when said two contact points engage said contact strip;

said power source includes two electrical leads extending from said power source to said contact points via said electrical counter means.

* * * * *